US006921561B1

(12) United States Patent
Maier

(10) Patent No.: US 6,921,561 B1
(45) Date of Patent: Jul. 26, 2005

(54) DECORATIVE ORNAMENT HANGER

(76) Inventor: Jan M. Maier, 1165 Legault Blvd., Ortonville, MI (US) 48462

( * ) Notice: Subject to any disclaimer, the term of this patent is extended or adjusted under 35 U.S.C. 154(b) by 0 days.

(21) Appl. No.: 10/438,195

(22) Filed: May 14, 2003

(51) Int. Cl.[7] ..... A47G 33/08; F16M 11/00

(52) U.S. Cl. ..... 428/11; 428/99; 428/100; 40/409; 248/690; 248/691; 248/692; 248/339; 24/343; 24/244

(58) Field of Search ..... 428/7, 11, 99, 428/100; 40/409; 248/690, 691, 692, 339; 24/343, 344

(56) References Cited

U.S. PATENT DOCUMENTS 2,067,528 A * 1/1937 Greene ..... 428/8
2,085,343 A * 6/1937 Steeple ..... 428/11
4,074,838 A * 2/1978 Blasnik et al. ..... 223/85
4,174,132 A * 11/1979 Crook, Jr. ..... 294/82.3
5,277,948 A * 1/1994 Daun ..... 428/7
5,624,094 A * 4/1997 Protz, Jr. ..... 248/231.81
D436,838 S * 1/2001 Kirk ..... D8/370
6,361,187 B1 * 3/2002 Adams ..... 362/252
6,363,637 B1 * 4/2002 Birmingham ..... 40/440
6,540,189 B2 * 4/2003 Hsiang ..... 248/318

* cited by examiner

*Primary Examiner*—Stephen Stein
(74) *Attorney, Agent, or Firm*—John R Benefiel

(57) ABSTRACT

An ornament hanger has a main piece in the form of a star or other decorative shape to which a pair of oppositely directed hooks are rotatably mounted so as to be detachable. An upper hook supports the hanger and a bottom hook supports another ornament. A series of ornament hangers can be used to secure string ornaments on a Christmas tree. The hanger can be used by itself as an ornament by detaching one hook.

10 Claims, 3 Drawing Sheets

DECORATIVE ORNAMENT HANGER

BACKGROUND OF THE INVENTION

This invention concerns ornament hangers of a type used to hang Christmas tree decorations. It has heretofore been proposed to provide an ornament hanger which itself ornamental. See U.S. Pat. Des. 427,712; Des. 436,838; and U.S. Pat. No. 3,123,514.

However, the hangers shown in those patents have themselves only limited ornamental value due to the relative prominence of hooks extending from a decorative piece.

Strings of electrical lights, and other string ornamentation are commonly held haphazardly on the branches of Christmas tree, and there is a need for a hanger which can be effectively used with such string ornamentation for securely positioning the same on the tree.

It is the object of the present invention to provide Christmas tree hanger for ornaments which itself has a high degree of ornamental attractiveness.

It is a further object of the present invention to provide a hanger which is particularly useful for hanging string ornamentation such as electric lights on a Christmas tree.

SUMMARY OF THE INVENTION

The above objects and others which will become apparent upon a reading of the following specification and claims are achieved by a hanger comprised of a decorative main piece having a decorative form such as a star.

Projecting from each of the top and bottom of the main piece there is mounted a smaller relatively inconspicuous hook, each top and bottom hook being rotatably and detachably secured to the main piece.

In a first embodiment the hooks are snap fit into a slot in a rear projecting tab adjacent the top and bottom of the main piece respectively, with a headed end on each hook preventing endwise movement of the hook out of the slot.

In a second embodiment, each hook is snap fitted into a radial groove in a thicker ornamental main piece, with an enlarged region of the groove receiving a headed portion of the hook.

In both embodiments, each hook has a bight portion which projects from the ornamental main piece to be engageable with a tree branch or another supported ornament. The rotatable mounting of the hooks allow selective positioning of the ornamental main piece in any orientation, and also allows selective orientation of the hooks to connect to a string ornament in any direction to enable securement of the string ornament by the hanger supported on a tree branch.

Each hook is detachable to allow use of the decorative main piece alone as an ornament suspended from a single hook holding the main piece.

The hooks can have a notched locator feature in the hook inner radius for receiving a wire of a string of lights or another ornament hanger, and also have a snap locked clasp to insure retention of a hooked connection to a tree branch or another ornament.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
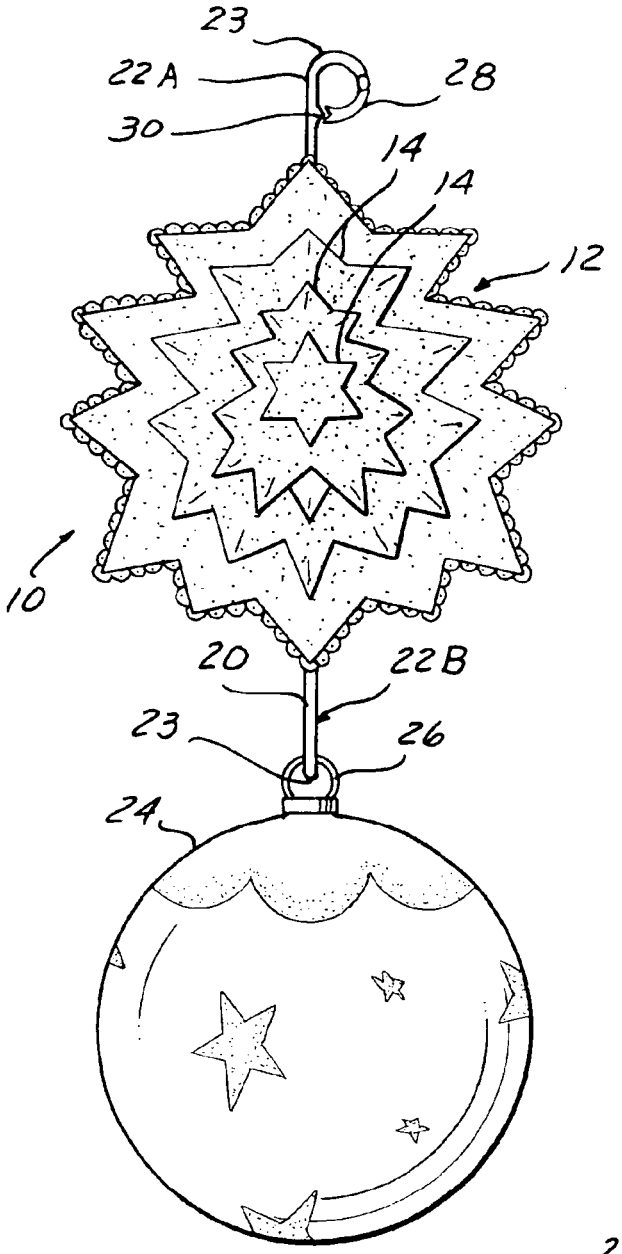
FIG. 1 is a front elevational view of an ornament hanger according to the invention and an ornament hanger thereby.
Figure 2:
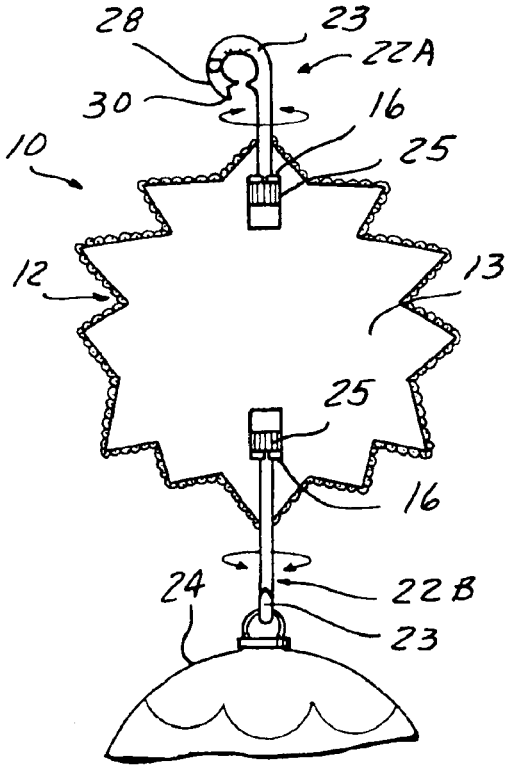
FIG. 2 is a rear elevational view of the ornamental hanger shown in FIG. 1 with a fragmentary view of an ornament hung thereby.
Figure 3:
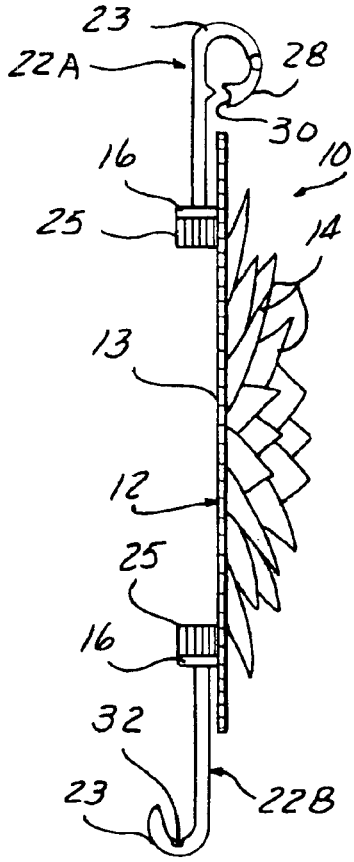
FIG. 3 is a side elevational view of the ornament hanger shown in FIGS. 1 and 2.
Figure 8:
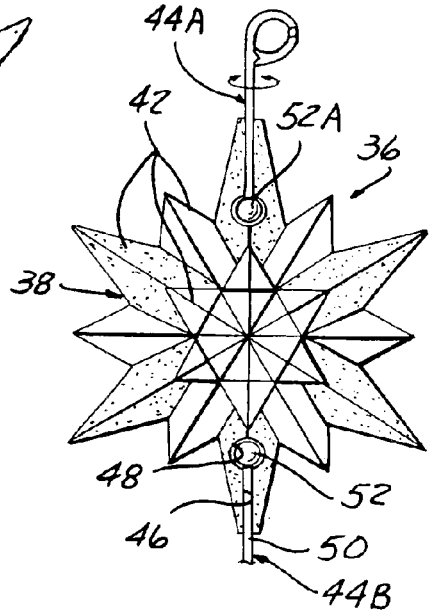
FIG. 8 is a back view of a second embodiment of the ornament hanger according to the invention.
Figure 10:
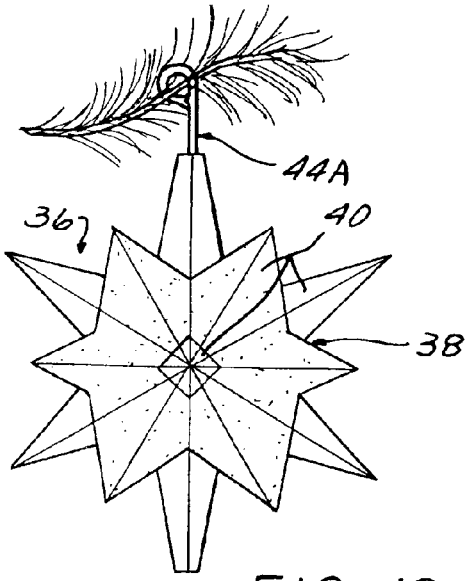
FIG. 10 is a front view of the ornament hanger shown in FIG. 8, hung on a branch with one hook removed to use the ornament hanger itself as an ornament.

Referring to the drawings, FIGS. 1–3 show the ornament hanger 10 according to the invention which comprises a main piece 12 of a decorative form, such as the star shape shown. Many other decorative shapes are of course possible. While generally planar, decorative contours 14 projecting forwardly may be formed in one side of the backing portion 13 as seen in FIG. 3, and the main piece may also be contoured on both front and back as seen in FIGS. 8 and 10.

Figure 4:
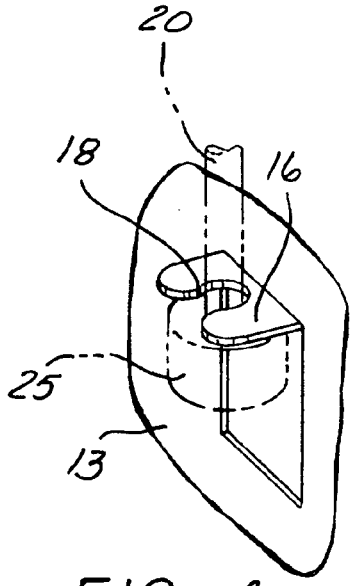
FIG. 4 is an enlarged fragmentary perspective view of a rear portion of the ornament hanger showing the connection to the hook element included in the hanger.

A pair of hook mounting tabs 16 project rearwardly from the backing portion 13 of the main piece 12 adjacent opposite sides of the backing portion 13. Each tab 16 is formed with a central cut out or slot 18 (FIG. 4) partially open so as to be able to receive and thereafter capture a shank 20 of a respective top or bottom hook 22A, 22B and releasably secure the same. A hook end headed portion 25 prevents endwise pull out of the hooks 22A, 22B from their respective mating slot 18.

Each hook 22A, 22B has a bight portion 23 projecting outwardly from the perimeter of the main piece 12 when installed.

The hook 22A when serving as a top hook can be secured on a tree branch to support the hanger 10. An ornament 24 can then be hung using the lower hook 22B on the opposite side, received in an ornament loop 26.

The hooks 22A, 22B can be formed of plastic or metal wire or thin rods, and a snap connector can be provided comprised of a clasp 28 and notched tip 30 on the hooks 22A, 22B.

Figure 5:
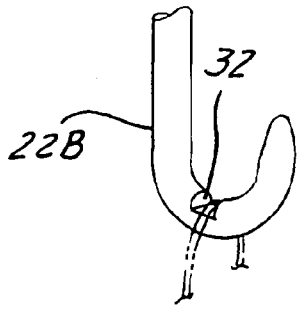
FIG. 5 is an enlarged fragmentary perspective view of one of the hooks showing a locator notch formed therein.
Figure 6:
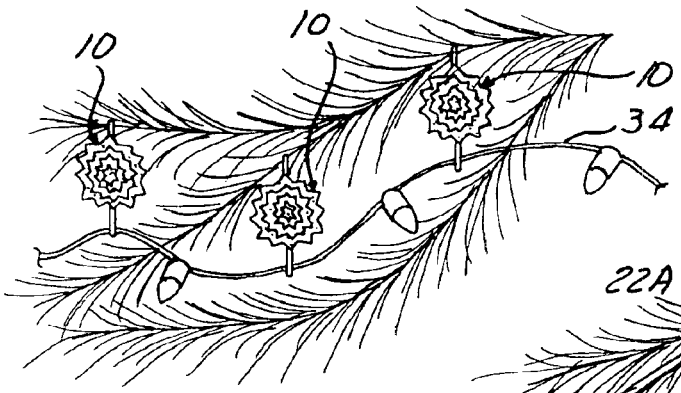
FIG. 6 is a fragmentary view of a Christmas tree branching showing a series of hangers according to the invention supporting a string of Christmas lights.

A locator notch 32 (FIG. 5) can optionally be formed in the inside of the hook bight curve. The notch 32 is useful when a series of the hangers 10 are used to support a string ornament such as a set of lights 34 (FIG. 6). The rotatable hooks 22A, 22B can be used to turn the hooks 22A, 22B so as to be properly oriented to receive the string ornament without any tendency to twist the string in any way.

Figure 7:
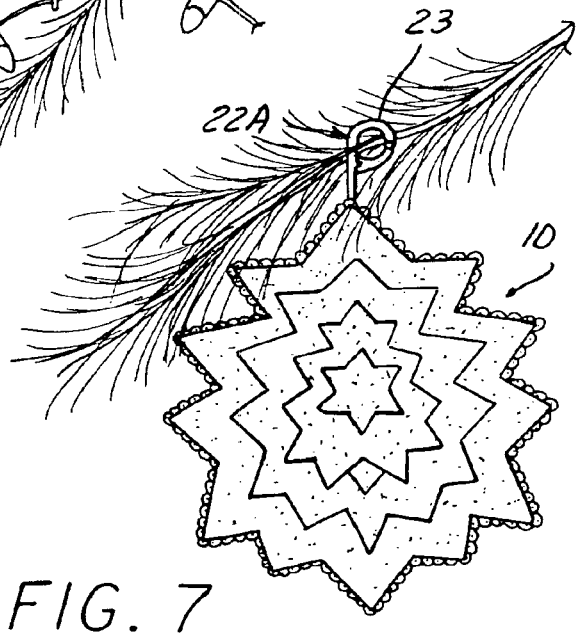
FIG. 7 is a front view of a hanger according to the present invention configured for use as an ornament.

One of the hooks 22A, 22B can be removed to allow use of a hanger 10 alone as an ornament (FIG. 7).

Thus, a hanger which has a removable rotatable hook mounted on either end of a large ornamental piece allows hanging of separate ornaments in a selected orientation, and also allows effective use of the hanger itself as an ornament.

Figure 9:
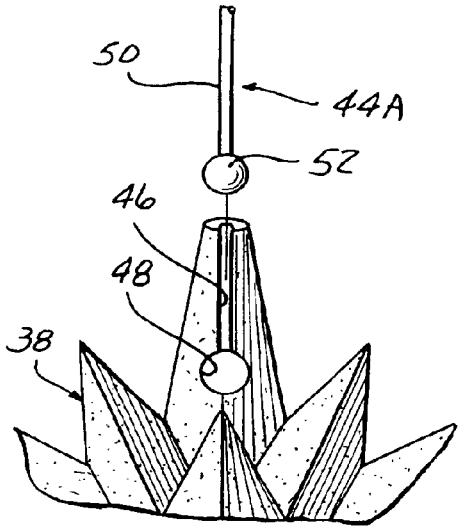
FIG. 9 is an enlarged fragmentary portion of the ornament hanger shown in FIG. 8.

FIGS. 8–10 show a second embodiment of an ornament hanger 36, which has a decorative main piece 38, contours 40, 42 formed on both the front and back respectively. A top and bottom hooks 44A, 44B are each rotatably and detachably mounted to the top and bottom of the main piece 38 to provide oppositely extending hooks for supporting the ornament hanger 36 as well as another ornament as in the above described embodiment.

The hook mounting is provided by a radial groove 46 entering into a respective semispherical socket 48, which each respectively receive the shank 50 and ball end 52 portions of the hooks 44A, 44B.

The grooves 46 are preferably configured to establish a snap fit to the shank portions 52. To install, a ball end 52 is placed in a socket 48 and the shank 50 rotated into the groove 46.

Only one hook 44A, may be used when the ornament hanger 36 is used as an ornament by itself

What is claimed is:

1. An ornament hanger comprising:

a main piece having a decorative shape;

a first hook rotatably secured to one side of said main piece to project outwardly from said main piece with a bight portion at a free end thereof; and a second hook rotatably secured to said main piece to project outwardly from another side of said main piece opposite said one side thereof in an opposite direction with a bight portion at a free end thereof; wherein at least one of said hooks has a shank portion which is detachably fit to said decorative main piece so as to project outwardly from said another side and be rotatable with respect to said main piece.

2. The ornament hanger according to claim 1 wherein said main piece is shaped in a star form.

3. The ornament hanger according to claim 1 wherein a bight portion of at least one of said hooks is formed with a locator notch on the inside bight portion adapted to receive a string ornament.

4. The ornament hanger according to claim 1 wherein each hook bight portion has a pivotable clasp engageable with a catch formed on said hook bight portion to enclose said hook about a tree branch or ornament.

5. The ornament hanger according to claim 1 wherein both hooks have a shank portion which is detachably fit to said main piece to project from a respective side of said decorative main piece.

6. The ornament hanger according to claim 1 wherein said at least one of said hooks with a shank portion is snap fit to a respective one of a pair of features on said decorative main piece.

7. The ornament hanger according to claim 6 wherein said decorative main piece is shaped as a Christmas ornament.

8. The ornament hanger according to claim 6 wherein said main piece is formed with a pair of tabs projecting from a rear face of said main piece, comprising said features each tab adjacent a respective one and another side thereof, and wherein each hook shank portion is snap fit into a slot in a respective tab.

9. The ornament hanger according to claim 8 wherein each tab is formed with a partial opening so as to allow a shank portion of a respective hook to be squeezed into said opening through a gap entering into said opening.

10. The ornament hanger according to claim 6 wherein a rear face of said main piece is formed with a pair of radial grooves each extending out to said one and another side thereof and comprising said main piece feature snap fit to said hook shank portion, and a socket formed at the inside end of each groove, each of said hooks formed with a ball end fit to a socket, and a shank snap fit to a respective groove.

* * * * *